US005428187A

United States Patent [19]

Crane et al.

[11] Patent Number: 5,428,187

[45] Date of Patent: Jun. 27, 1995

[54] SHIELDED HYBRID RIBBON CABLE ASSEMBLY

[75] Inventors: Burke J. Crane, Lombard; Augusto P. Panella, Bolingbrook, both of Ill.

[73] Assignee: Molex Incorporated, Lisle, Ill.

[21] Appl. No.: 201,301

[22] Filed: Feb. 24, 1994

[51] Int. Cl.[6] ..... H01B 7/08; H01B 7/34

[52] U.S. Cl. ..... 174/36; 174/115; 174/117 F

[58] Field of Search ..... 174/36, 117 F, 117 FF, 174/115

[56] References Cited

U.S. PATENT DOCUMENTS

| | | | |
|---|---|---|---|
| 4,323,721 | 4/1982 | Kincaid et al. | 174/36 |
| 4,327,246 | 4/1982 | Kincaid | 174/36 |
| 4,533,790 | 8/1985 | Johnston et al. | 174/115 |
| 5,025,115 | 6/1991 | Sayegh et al. | 174/117 F |
| 5,053,583 | 10/1991 | Miller et al. | 174/36 |
| 5,057,646 | 10/1991 | Nichols et al. | 174/36 |
| 5,097,099 | 3/1992 | Miller | 174/36 |
| 5,162,611 | 11/1992 | Nichols, III et al. | 174/36 |
| 5,342,991 | 8/1994 | Xu et al. | 174/117 R |

FOREIGN PATENT DOCUMENTS

| | | | |
|---|---|---|---|
| 3336195 | 5/1984 | Germany | 174/117 F |

OTHER PUBLICATIONS

Vol. 3 Handbook Series on Electromagnetic Interference and Compatibility (EMI Control Methods and Techniques) By: Donald R. J. White, Copyright 1973.

*Primary Examiner*—Morris H. Nimmo
*Attorney, Agent, or Firm*—Stephen Z. Weiss

[57] ABSTRACT

A shielded hybrid ribbon cable assembly is provided for conducting electrical power and data signals. The assembly includes a plurality of spaced, parallel, power conductors and a plurality of data signal conductors. An insulating material holds together and electrically insulates the plurality of conductors. An electrically conductive shield is disposed about at least the data signal conductors for shielding electromagnetic capacitive interference. An inductive shielding means is interposed between the power conductors and the data signal conductors for shielding the signals of the data signal conductors from inductive magnetic interference generated by the power conductors.

15 Claims, 3 Drawing Sheets

SHIELDED HYBRID RIBBON CABLE ASSEMBLY

FIELD OF THE INVENTION

This invention generally relates to the art of electrical cables and, particularly, to a shielding system for a folded ribbon cable assembly.

BACKGROUND OF THE INVENTION

There are a wide variety of electrical wiring systems for transmitting various types of electrical signals. Depending on the type of signal being transmitted along a wire, a selected type of wire is used to give the best performance in a particular environment. Wire types are selected to provide better noise immunity, for instance, and power wires must have a proper gauge to withstand a driven current.

When wiring newly constructed buildings, such as a residential home, wires used for different purposes most often are wired separately. For instance, telephone wiring, security wiring, entertainment system wiring, built-in communication system wiring and the normal power wiring have been installed separately. These installations are costly and difficult to repair once installed.

In order to provide more efficient wiring systems that solve the problems inherent to the separate system described above, and to provide a more uniform wiring system, a single hybrid ribbon cable assembly has been developed. A few examples of such hybrid ribbon cable assemblies are shown in U.S. Pat. Nos. 5,053,583 to Miller et al, dated Oct. 1, 1991; 5,057,646 to Nichols et al, dated Oct. 15, 1991; 5,097,099 to Miller, dated Mar. 17, 1992; and 5,162,611 to Nichols, III, dated Nov. 10, 1992. All of these patents show some form or another of a hybrid ribbon cable assembly wherein 60 hertz 110 volt power conductors are integrated in the same ribbon cable assembly with small gauge data conductors which may be provided for transmitting digital data communications, for instance.

One of the problems that have been encountered with hybrid ribbon cable assemblies which combine data and power wire conductors or cables is that during spikes in the current flow on the power conductors, electrical currents may be generated in the data conductors or cables creating faulty data impulses. Heretofore, attempts have been made to employ flexible metal shields completely surrounding the data conductors. The shields were formed of aluminum foil on one or both sides of a plastic film. However, this arrangement is not possible if the group of data conductors and the group of power conductors, both of which are held together with insulating material, are to remain joined together at the connection portion of insulating material. In an attempt to shield the data conductors, both the data and power conductors of the hybrid cable have been enveloped by the shield. The hybrid cable and shield was formed into a more usable C-shaped geometry. In this C-shaped form, the data and power conductors are located adjacent one another such that the data conductors are within the magnetic field of the power conductors. In this configuration these shields, although able to shield capacitive interference (i.e. high frequency interference), are inadequate to shield the data conductors from inductive coupling (i.e. low frequency interference). In other words, simply wrapping the data and power conductors in an electrically conductive film, such as of aluminum or copper, has proven inadequate.

The present invention is directed to solving these problems by providing a unique shielded hybrid ribbon cable assembly which includes a shielding means of high permeability.

SUMMARY OF THE INVENTION

An object, therefore, of the invention is to provide a new and improved shielded hybrid ribbon cable assembly of the character described.

In the exemplary embodiment of the invention, a one-piece, generally C-shaped, shielded hybrid ribbon cable assembly is provided for conducting electrical power and data signals. The assembly includes a set of parallel spaced-apart power conductors embedded in insulating material defining a power section, and a set of parallel spaced-apart signal conductors embedded in the insulating material defining a data portion. The insulating material joins the power and data portions to define a hingeable connecting portion. The cable assembly is adapted to be folded at the connecting portion to form the C-shaped configuration wherein the power and data portions define the legs and the connecting portion defines the bight of the C-shaped configuration.

The invention contemplates that an outer capacitive shield in the form of an electrically conductive film surround the outer surface of the insulating material, at least the data portion thereof, for shielding the assembly from electromagnetic capacitive interference. Also, a generally planar, inductive shielding means is interposed between the legs of the C-shaped assembly for shielding the signals of the data portion from the inductive magnetic interference generated by the power portion.

In the preferred embodiment of the invention, the electrically conductive film of the capacitive shield is fabricated of metal material such as aluminum or copper foil laminated to one or both sides of a plastic film. The inductive shielding means is fabricated of metal material such as a tin-plated low carbon steel, silicon iron or the like. A dielectric tubular outer jacket surrounds the cable assembly and holds the shielding means between the power portion and the data portion of the hybrid ribbon cable assembly.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
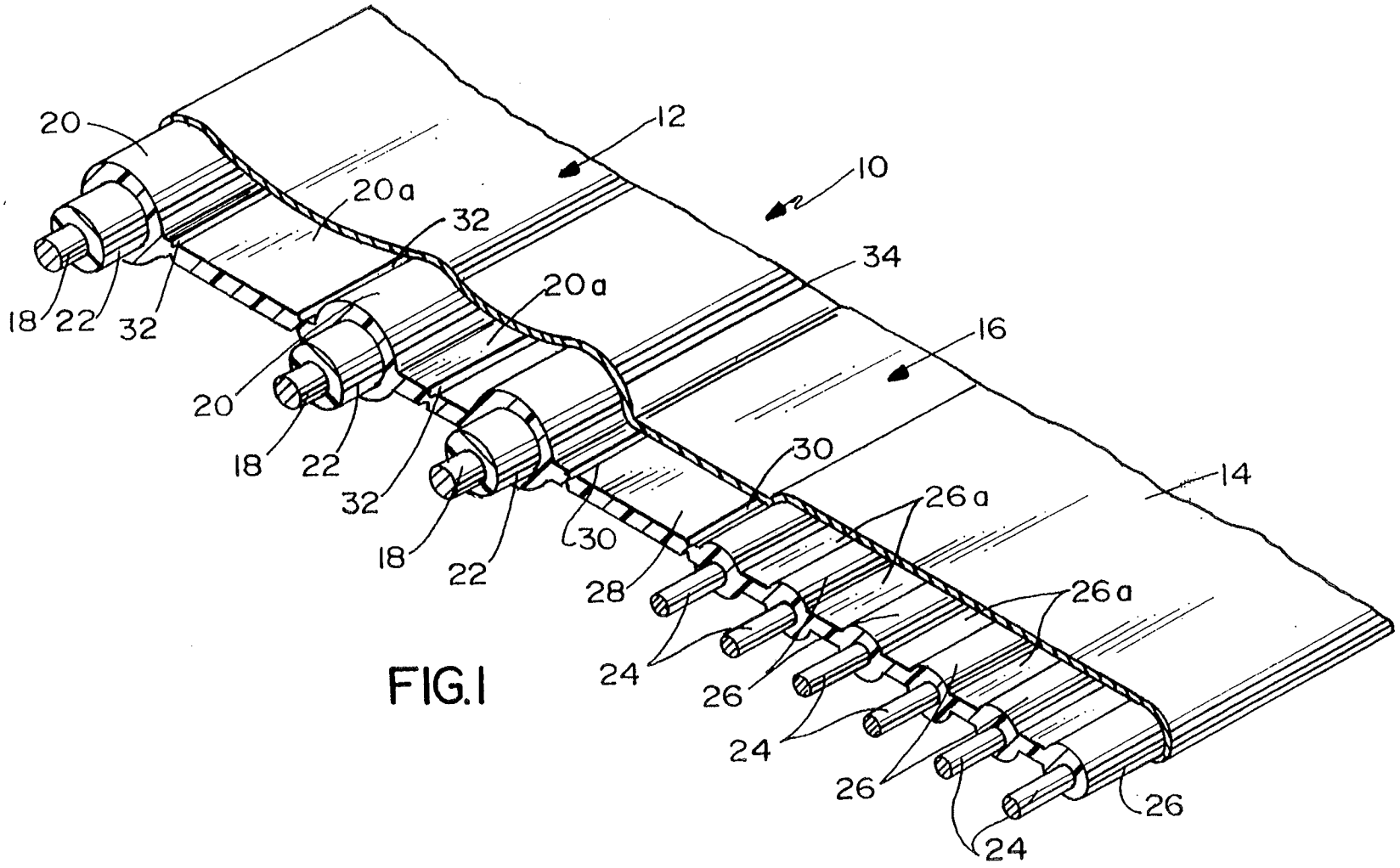
FIG. 1 is a perspective view of a shielded hybrid ribbon cable in its normal planar or unfolded condition, with the insulation and conductive film stripped back to facilitate the illustration.
Figure 2:
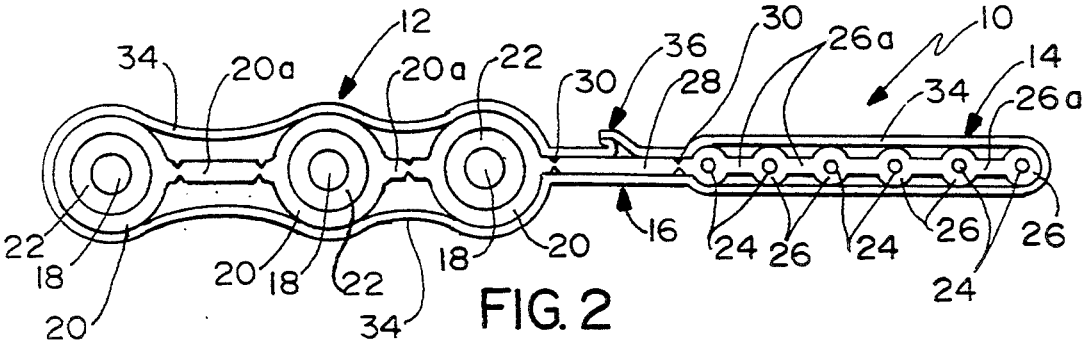
FIG. 2 is a end elevational view of the cable of FIG. 1.

Referring to the drawings in greater detail, and first to FIGS. 1 and 2, a shielded hybrid ribbon cable, generally designated 10, is illustrated and is of the type applicable for use with the cable assembly of the invention. Basically, ribbon cable 10 includes a power portion, generally designated 12; a data portion, generally designated 14; and a connecting portion, generally designated 16, between power portion 12 and data portion 14.

More particularly, power portion 12 includes a set of parallel spaced-apart power conductors 18 embedded in an insulating material 20. The insulating material is integral or unitary with web portions 20*a* of the material between the power conductors. Each power conductor, itself, is surrounded in a sheath of insulating material 22. As is well known in the art, one of the power conductors 18 is the positive or "hot" conductor, another is the neutral conductor and the remaining conductor is the ground conductor. The conductors may be #14 gauge copper wire, for instance.

Data portion 14 includes a set of parallel spaced-apart signal conductors 24 embedded in insulating material 26 which is integral or unitary with insulating web portions 26*a*. The signal conductors may be of #24 gauge copper wire, for instance.

Connecting portion 16 basically is a short, planar section 28 of insulating material. V-shaped indented notches or troughs 30 are formed longitudinally of the cable along each side of insulating section 28 to facilitate the section acting as a hinge between power portion 12 and data portion 14, as described hereinafter. Similar troughs or notches 32 may be provided in insulating webs 20*a* of power portion 12 simply to increase the pliability of the insulating material. In actual practice, insulating material 20 about power conductors 18 and the insulating webs 20*a* therebetween, the insulating material 26 about signal conductors 24 and insulating webs 26*a* therebetween, and insulating section 28 all comprise a unitary or integrally molded dielectric structure.

Lastly, hybrid ribbon cable 10 includes an electrically conductive film 34 surrounding the outer surface of the insulating material described above for shielding the hybrid ribbon cable from electromagnetic capacitive interference (i.e. high frequency interference). In the preferred embodiment as shown, electrically conductive film 34 surrounds the outer surface of the entire hybrid ribbon cable 10. The film should at least surround data portion 14 of the cable. The film is fabricated from a metal foil material such as aluminum, copper or the like laminated to one or both sides of a plastic film.

Figure 3:
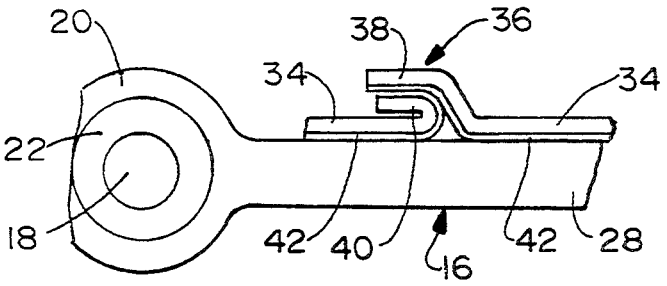
FIG. 3 is a fragmented enlarged end view of the connecting portion of the cable.

Referring to FIG. 3 in conjunction with FIG. 2, electrically conductive film 34 is joined at a seam, generally designated 36, wherein one end 38 of the sheet of film overlaps a folded-over end 40 of the film. Actually, these ends 38 and 40 are the edges of a sheet of film surrounding the ribbon cable, the edges running the length of the cable. The fold is to assure that the conductive skin 42 of the film 36 makes an electrically conductive continuous envelope both axially and circumferentially around the hybrid cable.

Figure 4:
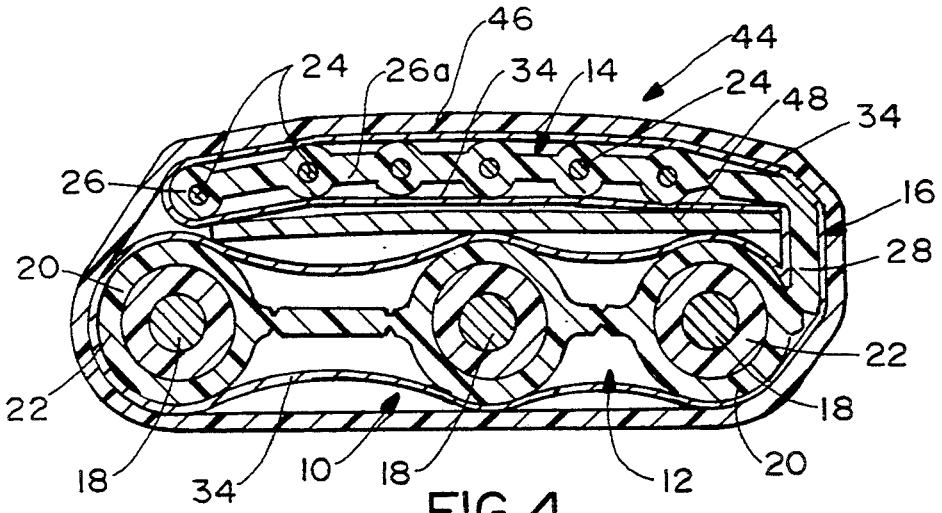
FIG. 4 is a transverse section through the shielded hybrid ribbon cable assembly of the invention.

FIG. 4 shows a one-piece shielded hybrid ribbon cable assembly, generally designated 44, wherein hybrid ribbon cable 10 is folded into a generally C-shaped configuration. The entire assembly is surrounded by a dielectric tubular outer jacket 46 of plastic or like insulating material. In this configuration, generally, the invention contemplates integrating an inductive shielding means 48 within the assembly for shielding the signals of data portion 14 (i.e. signal conductors 24) from inductive magnetic interference (i.e. low frequency) generated by power portion 12 (i.e. power conductors 18). In the preferred embodiment, and with ribbon cable 10 folded into a C-shaped configuration, shielding means 48 is generally planar and is integrated within the folded-over ribbon cable. In other words, power and data portions 12 and 14, respectively, can be considered as forming the legs of the C-shaped configuration, and connecting portion 16 can be considered as forming the bight of the C-shaped configuration. Shielding means 48, therefore, is interposed between the legs of the C-shaped assembly.

Inductive shielding means 48 is fabricated of a material of high permeability. In the preferred embodiment of the invention, the high permeable material is a metal material such as a tin-plated low carbon steel or the like. The plated steel is a very cost effective material. However, other high permeability metal material could be used, such as Mu-metal (trademark of Telegraph Construction and Maintenance Company), Permalloy (trademark of Western Electric) or silicon iron, if cost considerations are not significant. Lastly, it can be seen in FIG. 4 how dielectric tubular outer jacket 46 surrounds cable assembly 44 and holds inductive shielding means 48 interposed between the power and data portions of the ribbon cable.

Figure 5:
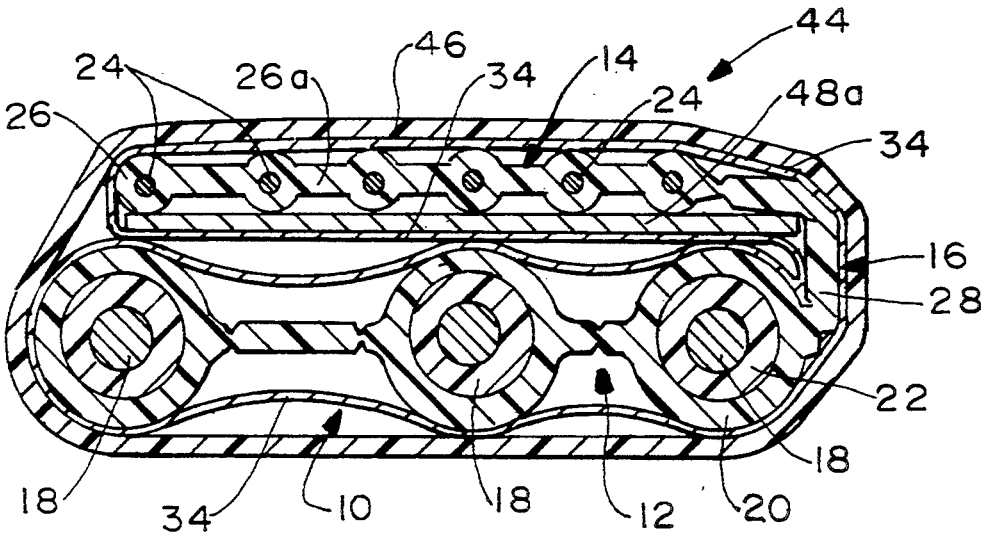
FIG. 5 is a view similar to that of FIG. 4, but of an alternate embodiment of the invention.

FIG. 5 shows an alternative embodiment of the invention which involves locating the high permeable shielding means within the electrically conductive shielding film. FIG. 5 can be compared to FIG. 4, and like reference numbers have been applied to like components in both figures. In FIG. 5, a generally planar inductive shielding means 48A is provided, again, of a material of high permeability. The inductive shielding means is located on the interior of electrically conductive film 34 and on the inside of signal conductors 24, as the ribbon cable is folded into its generally C-shaped configuration.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A one-piece, generally C-shaped, shielded hybrid ribbon cable assembly for conducting electrical power and data signals including a set of parallel spaced-apart power conductors embedded in insulating material defining a power portion, a set of parallel spaced-apart signal conductors embedded in said insulating material defining a data portion, said insulating material joining said power and data portions to define a hingeable connecting portion, and said cable assembly being adapted to be folded at the connecting portion to form the C-shaped configuration wherein said power and data portions define the legs and the connecting portion defines the bight of the C-shape, the improvement in said cable assembly comprising:

an electrically conductive film surrounding the outer surface of said insulating material for shielding said assembly from electromagnetic capacitive interference; and generally planar inductive shielding means interposed between the legs of the C-shaped assembly for shielding the signals of the data portion from the inductive magnetic interference generated by the power portion.

2. The improvement of claim 1 wherein said electrically conductive film is fabricated of metal material such as aluminum or copper.

3. The improvement of claim 1 wherein said shielding means is fabricated of a material having high permeability.

4. The improvement of claim 3 wherein said electrically conductive film is fabricated of metal material such as aluminum, copper and the like.

5. The improvement of claim 1, including a dielectric tubular outer jacket surrounding the cable assembly.

6. The improvement of claim 1 wherein edges of said electrically conductive film are electrically joined at a seam.

7. The improvement of claim 1, wherein said inductive shielding means is located inside the electrically conductive film.

8. A shielded hybrid ribbon cable assembly for conducting electrical power and data signals, including a plurality of spaced, parallel, power conductors and a plurality of data signal conductors, an insulating material for holding together and electrically insulating the plurality of conductors, wherein the improvement comprises an electrically conductive shield about at least the data signal conductors for shielding from electromagnetic capacitive interference, and inductive shielding means between the power conductors and the data signal conductors for shielding the signals of the data signal conductors from inductive magnetic interference generated by the power conductors.

9. The shielded hybrid ribbon cable assembly of claim 8 wherein said inductive shielding means is fabricated of a material of high permeability.

10. The shielded hybrid ribbon cable assembly of claim 9 wherein said inductive shielding means is fabricated of metal material such as a tin-plated low carbon steel.

11. The shielded hybrid ribbon cable assembly of claim 10 wherein said electrically conductive shield comprises an electrically conductive film.

12. The shielded hybrid ribbon cable assembly of claim 11 wherein said electrically conductive film is fabricated of metal material such as aluminum or copper.

13. The shielded hybrid ribbon cable assembly of claim 8 wherein said electrically conductive shield extending completely about said data signal and power conductors and the edges of said electrically conductive shield are electrically joined at a seam.

14. The shielded hybrid ribbon cable assembly of claim 8, including a dielectric tubular outer jacket surrounding the cable assembly and holding the inductive shielding means between the power conductors and the data signal conductors.

15. The shielded hybrid ribbon cable assembly of claim 8 wherein said electrically conductive shield surrounds at least the data signal conductors, and the inductive shielding means is located inside the electrically conductive shield.

* * * * *